US006578478B2

(12) United States Patent
Doppler

(10) Patent No.: US 6,578,478 B2
(45) **Date of Patent: *Jun. 17, 2003**

(54) ELECTROSTATIC ARRANGEMENT FOR ROTOGRAVURE AND FLEXOGRAPHIC PRINTING UNIT

(75) Inventor: Alfred Doppler, Bättwil (CH)

(73) Assignee: Spengler Electronic AG, Biel-Benken (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/555,182

(22) PCT Filed: Nov. 27, 1997

(86) PCT No.: PCT/CH97/00447

§ 371 (c)(1),
(2), (4) Date: May 24, 2000

(87) PCT Pub. No.: WO98/03049

PCT Pub. Date: Jan. 29, 1998

(65) Prior Publication Data

US 2003/0066443 A1 Apr. 10, 2003

(51) Int. Cl.[7] ..... B41F 9/08
(52) U.S. Cl. ..... 101/153; 118/621
(58) Field of Search ..... 101/DIG. 37, 489, 101/150, 153, 170; 118/620, 621

(56) References Cited

U.S. PATENT DOCUMENTS 3,625,146 A 12/1971 Hutchinson
4,440,082 A * 4/1984 Carey et al. ..... 101/170
4,539,908 A * 9/1985 Spengler ..... 101/426
4,909,147 A * 3/1990 George et al. ..... 101/170
5,044,275 A 9/1991 Knopf et al.
5,829,355 A 11/1998 Spengler
6,000,333 A * 12/1999 Davis ..... 101/132

FOREIGN PATENT DOCUMENTS

| | | |
|---|---|---|
| DE | 2709254 | 11/1977 |
| DE | 2810452 | 9/1979 |
| DE | 9419540 | 3/1995 |
| EP | 0115611 | 8/1984 |
| EP | 0294042 | 12/1988 |
| EP | 0351504 | 7/1992 |
| EP | 0761458 | 3/1997 |
| JP | 62244860 | 10/1987 |

OTHER PUBLICATIONS

Ollech, Bernd: Tiefdruck, Grundlagen und Verfahrensschritte der modernen Tiefdrucktechnik, second edition 1993, p. 343, Fig. 15.49.

(List continued on next page.)

*Primary Examiner*—Eugene H. Eickholt
(74) *Attorney, Agent, or Firm*—Selitto, Behr & Kim

(57) ABSTRACT

The electrostatic printing aid for gravure and flexographic printing machines can be operated with a voltage electrode whose dimensions have been reduced significantly, the print quality being kept at a high level. The voltage electrode, connected to a high voltage source, can be constructed with a bar-like or arc-like shape and to be non-contacting, or as a slip ring or as an electrically conductive brush. The voltage electrode is preferably arranged at one end of the three-layer impression roller of a gravure printing unit or the three-layer printing plate cylinder of a flexographic printing unit. The particular advantages of the arrangement reside in the significantly improved ease of servicing and the saving in costs, as early as at the time of purchase, in particular in the event of retrofitting printing machines already in operation.

28 Claims, 9 Drawing Sheets

OTHER PUBLICATIONS

Eltex–Elektrostatik GmbH, Weil am Rhein, Germany, "ESA Direkt—Eine neue Dimension der elektrostatischen Druckhilfe", publication No. WP–d/e/f–9043–90/7–20, Fig. 17.

"Eltex–Handbuch der Elektrostatischen Disziplin", publication No. Üp–d–0002–93/12–100, p. 32, printing assistance, Fig. top right.

Spengler Electronic AG, Biel–Benken, Switzerland, Elektrostatische Druckhilfe, SR–Heliofurn 94.

Shinko Co., Ltd., Osaka, Japan, ESAPrint 21, Electrostatic Assist System, publication No. 97043000.

* cited by examiner

Fig. 1C
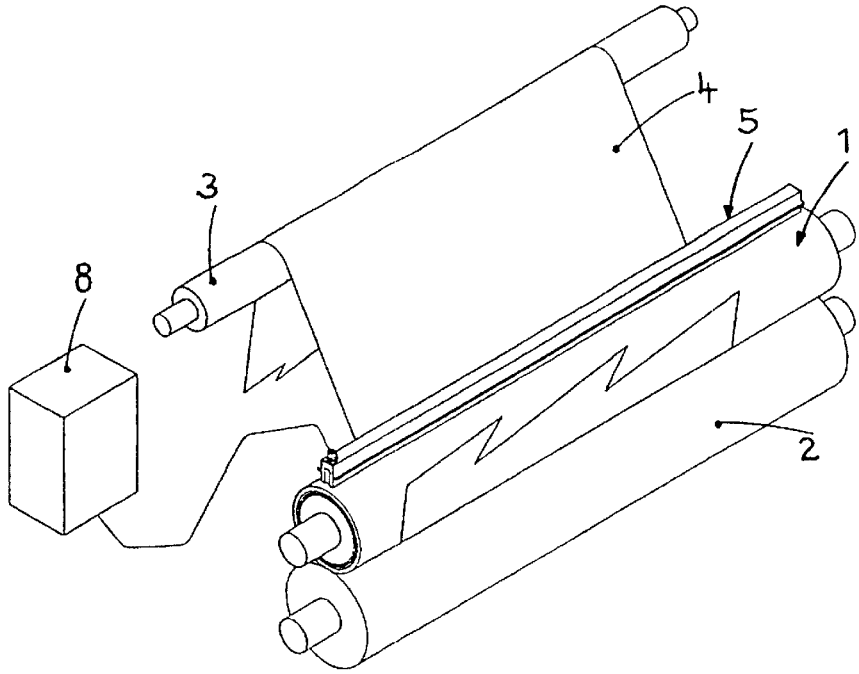
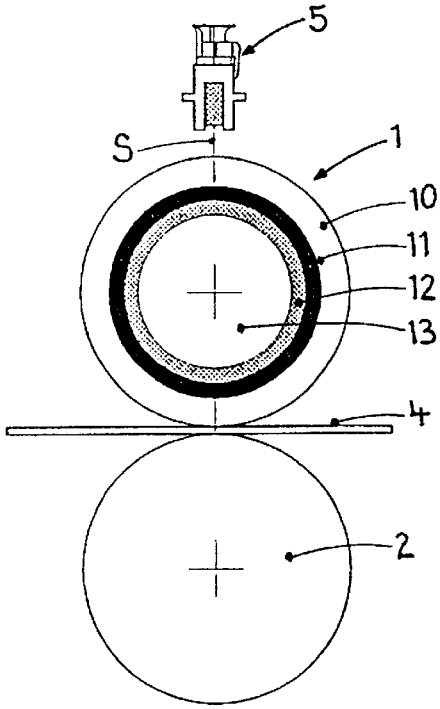
Fig. 1D
Fig. 1E
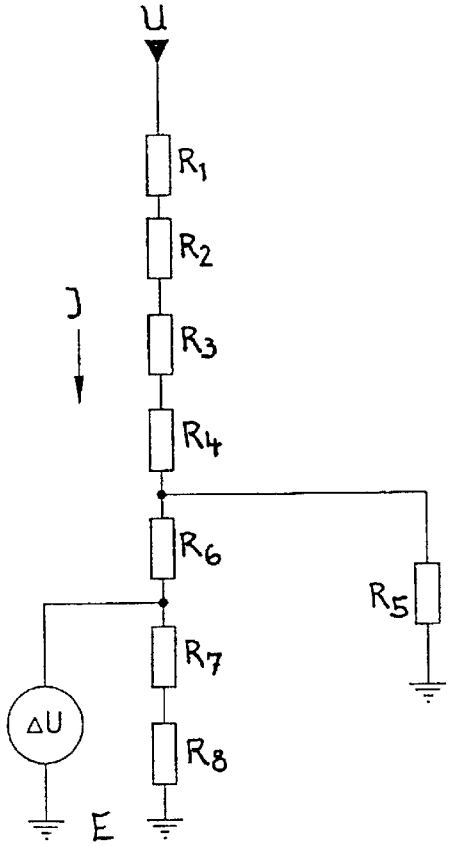

Fig. 7A
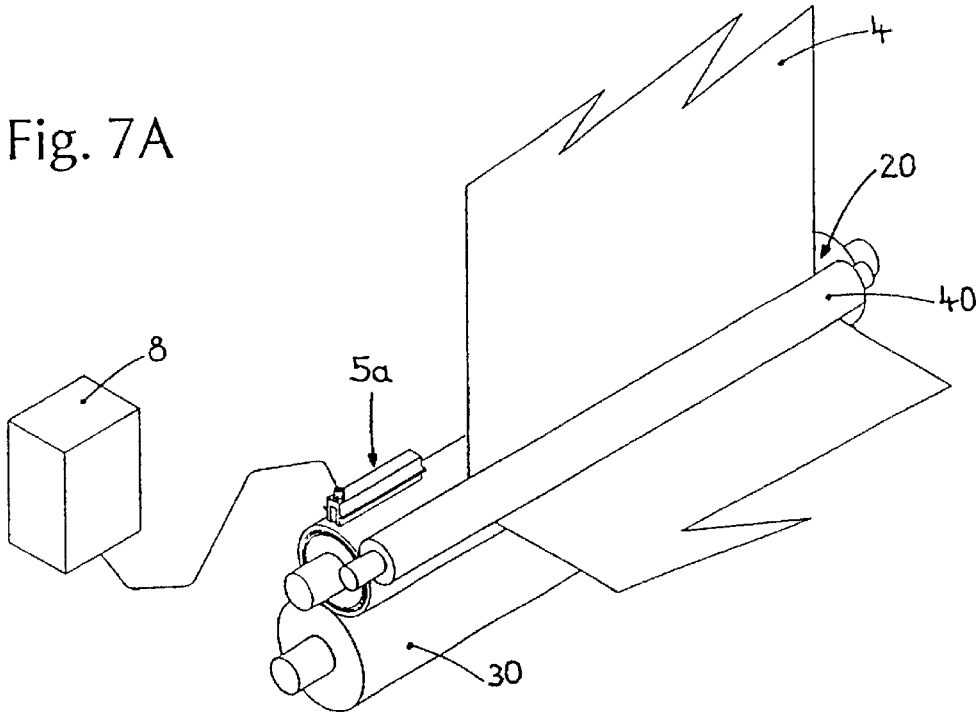
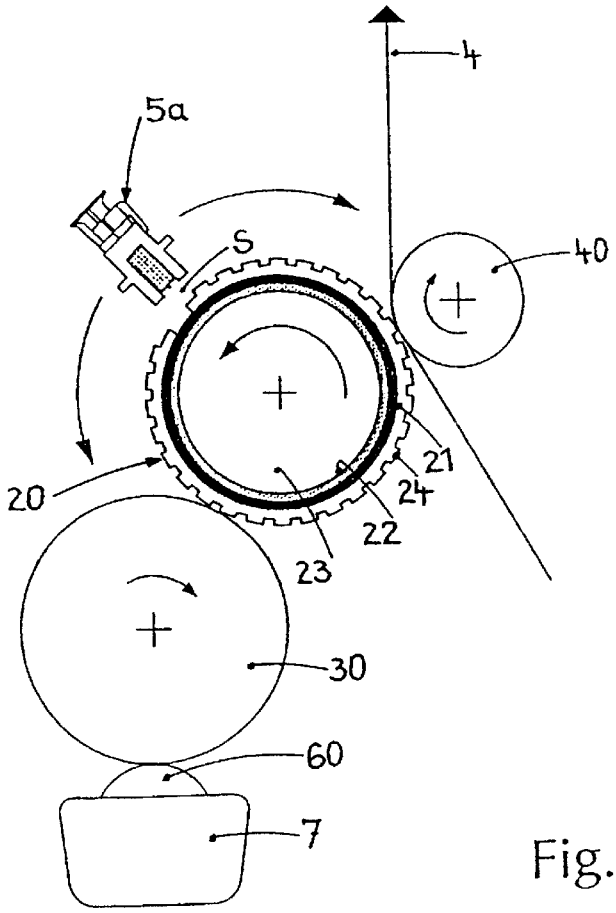
Fig. 7B

ELECTROSTATIC ARRANGEMENT FOR ROTOGRAVURE AND FLEXOGRAPHIC PRINTING UNIT

FIELD OF APPLICATION OF THE INVENTION

The present invention relates to an arrangement for transferring an electrostatic charge within a gravure and flexographic printing unit in order to improve the print quality by polarizing the drops of printing ink on the printing plate cylinder. In the gravure printing unit, the electrostatic charge is applied to the outer circumference of an impression roller, from which it flows away toward the outer circumference of the printing plate cylinder. In the flexographic printing unit, the electrostatic charge is applied to the printing plate cylinder, from which it flows away both toward the substrate transfer roll and toward the back-pressure cylinder. Under the influence of an applied electric field, the ink molecules in the dimples in the printing plate cylinder (gravure printing) or those on the surface of the printing plate cylinder (flexographic printing) are polarized, and the ink droplets experience overall an increase in volume. A flowing electric current is picked up in order to supply the energy needed for the polarization work. As a consequence of the polarization, the ink droplets are attracted by the printing material and, moreover, the transfer of the ink droplets to the printing material led past is promoted by their increase in volume.

Thus, in gravure printing it is ensured to a significantly greater extent that the dimples in the printing plate cylinder are emptied satisfactorily, that is to say the printing ink is applied to the printing material. In flexographic printing, the electrostatic charge has the effect that the printing ink is transferred better from the substrate transfer roll to the printing plate cylinder and on to the printing material. Such arrangements are also referred to as "electrostatic printing aids"; they are used to achieve a full reflection density at all tonal levels and to avoid so-called "missing dots". The problem of "missing dots" occurs in particular with rough printing materials, for example paper webs, having corresponding irregularities.

PRIOR ART

Electrostatic printing aids of the generic type relevant here have been known for decades (see, for example DE-A-27 09 254; EP-A-0 761 458). FIGS. 1A and 1D, in conjunction with FIG. 1C, show a two-roll system in a gravure printing unit having a multi-layer impression roller 1—but here already having three layers, according to the invention—the printing plate cylinder 2 and the printing material 4 led between the two over the deflection roll 3. Arranged above the impression roller 1 is a rod-like voltage electrode 5 extending over its entire length. The ink doctor 6 for wiping off excessively applied ink from the printing plate cylinder 2 is indicated. The inking roller and the ink return are situated in an ink trough 7, but are not shown. The voltage electrode 5 is connected to a high-voltage source 8. The circumference of the three-layer impression roller 1 has, on the outside, a semiconductor layer 10 and, underneath the latter, a highly conductive layer 11. Located underneath the highly conductive layer 11, as an electrical insulation from the impression roller core 13, is an insulating layer 12.

FIG. 1B shows a three-roller system which, differing from the above-described two-roller system, has a supporting roll 9, which is preferably electrically insulated, additionally arranged above the multi-layer impression roll 1. Here, the voltage electrode 5 is positioned to the side of the multi-layer impression roller 1.

FIG. 1E, with the electric circuit diagram of the two or three-roller system according to FIGS. 1A to 1D, illustrates the current flow within the electrostatic arrangements. From the high-voltage source 8, a DC voltage U is fed to the voltage electrode 5, and the voltage electrode 5 has the internal resistance $R_1$. The air gap S—normally of the order of magnitude of about 5 mm to 30 mm—existing between the voltage electrode 5 and impression roller 1, represents the resistance $R_2$. The upper semiconductor layer 10 and the highly conductive layer 11 form the resistances $R_3$, $R_4$. The grounded insulation layer 12 acts as an extra large resistance $R_5$. From the highly conductive layer 11, the current flows through the semiconductor layer 10 which is arranged underneath and which here forms the resistance $R_6$, and onward through the printing material 4, which represents the resistance $R_7$. The grounded printing plate cylinder 2 has virtually the resistance value $R_8 = 0$ .

According to Kirchhoff's law of current distribution, the main proportion of the electric current takes the path of lowest resistance via the highly conductive layer 11, while a small fraction flows directly to the printing material 4 via the semiconductor layer 10. Finally, there is a voltage drop $\Delta U$ between the lower semiconductor layer 10 and the ground E which constitutes the so-called nip voltage, which is critical for the polarization of the ink droplets in the dimples in the printing plate cylinder 2. The current I flows to the ground connection E, starting from the voltage electrode 5.

In order to apply the ink droplets from the dimples as completely and uniformly as possible over the entire width of the printing material—the web widths can nowadays exceed 3 m—sufficient energy has to be supplied, and the current flow has to be distributed uniformly over the entire impression roller width. In order to satisfy this requirement, the length of the voltage electrode has hitherto depended on the maximum usable width of the printing plate cylinder or of the impression roller, so that a charge distribution which is homogeneous in the impression area is ensured on said printing plate cylinder or impression roller (see DE-A-27 09 254, p. 11, lines 21ff.; OLLECH, Bernd: Tiefdruck—Grundlagen und Verfahrensschritte der modernen Tiefdrucktechnik [gravure printing principles and process steps in modern gravure printing technology], Polygraph Verlag Frankfurt am Main, second edition 1993, p. 343, FIG. 15.49; company publications from Eltex-Elektrostatik GmbH, Weil am Rhein, Germany, "ESA-DIREKT—Eine neue Dimension der elektrostatischen Druckhilfe" [ESA-DIREKT—a new dimension in electrostatic printing aids], publication no.: WP-d/e/f-9043-90/7-20, FIG. 17; and "eltex-Handbuch der Elektrostatischen Disziplin" [eltex-handbook of the electrostatic discipline], publication no.: Üp-d-0002-93/12-100, p.32, printing assistance, Figure top right) As a result, use is made of voltage electrodes over 3 m in length. Good print qualities are achieved with such voltage electrodes. However, the drawbacks are the relatively quick contamination of the exposed voltage electrodes, which lead to considerable losses in terms of their effectiveness and ultimately to complete failure, so that the print quality rapidly deteriorates.

In order to obtain the function of the electrostatic arrangements equipped in this way, a contaminated voltage electrode has to be disassembled, cleaned and installed again. This requires a number of personnel, leads to extensive losses in terms of machine downtime and is therefore often delayed in order not to threaten existing delivery times for the printed products.

In order to eliminate the abovementioned disadvantages, the consequence has been that electrostatic printing aids have been developed where, instead of by means of a long, fitted bar electrode, the current was introduced into the rotating shaft of the impression roller (see, for example, DE-A-28 10 452). Then, although the problem of a voluminous voltage electrode had been eliminated, and servicing had therefore been made easier, there nevertheless remains the requirement for frequent cleaning; added to this, however, was an increased outlay in insulating the core of the impression roller with respect to the printing machine.

In the further development, encapsulated electrostatic printing aids were developed, where the current was introduced via the impression roller core and which were protected to the greatest possible extent against contamination, so that freedom from maintenance is virtually provided (see, for example, EP-A-0 115 611, the company publication from Spengler Electronic AG, Biel-Benken, Switzerland: Elektrostatische Druckhilfe [electrostatic printing aids], SR-HELIOFURN 94). These printing aids, which are the most modern to date, entail a relatively high mechanical outlay, which is still acceptable in the case of new printing machines which are equipped with it from the start. In the case of retrofitting older printing machines, which are already in operation, with encapsulated printing aids and introducing the current into the impression roller core, however, the outlay for retrofitting would rise enormously, so that for this purpose the earlier printing aids with long, bar-like voltage electrodes continue to be used (see, for example, most recently the company publication from SHINKO Co., Ltd., Osaka, Japan: ESAPRINT 21, ELECTROSTATIC ASSIST SYSTEM; publication no.: 97043000).

In addition, US-A-3 625 146 discloses electrostatic printing aids in which a roller electrode is fitted to a three-layer impression roller having an external semiconductor layer, a conductor layer located underneath and an insulating layer located underneath the latter and adjacent to the impression roller core. The roller electrode is in direct electrical contact with an exposed annular face of the conductor layer.

In an electrostatic arrangement disclosed by EP-A-0 294 042, a voltage electrode in the form of a brush is in direct electrical contact with a semiconductor layer of a multi-layer impression roller.

DE-U-94 19 540 describes an electrostatic arrangement in which a voltage electrode is arranged at a distance from an outer semiconductor layer of a three-layer impression roller having a highly conductive layer located under the semiconductor layer and an insulation layer located underneath said highly conductive layer and adjacent to the impression roller core. The voltage electrode, which is formed as a sheet-metal part, grating or the like, and the semiconductor layer and the highly conductive layer form a capacitor, which is suitable for transferring alternating voltage. A conventional alternating voltage or an alternating voltage rectified with one diode (=a non-smoothed DC voltage) is applied to the voltage electrode, the alternating voltage component generating the alternating current which can be transferred via the capacitor.

These last electrostatic printing aids are based on a different current transfer principle than the electrostatic arrangement described in DE-A-27 09 254, from which the electrostatic arrangements according to the independent patent claims 1 and 2 are delimited.

OBJECT OF THE INVENTION

In view of the continuing disadvantages of the electrostatic printing aids which exist to date, the invention is based on the object of providing an arrangement where a contaminated voltage electrode can quickly be dismantled, cleaned and installed again by one person. Otherwise, it should be possible to replace the contaminated voltage electrode quickly with a clean electrode, in order to perform the cleaning of the contaminated electrode externally. The outlay on servicing and machine downtimes must be reduced considerably. The arrangement should manage with electrodes of the smallest possible dimension, should in particular be suitable for retrofitting printing machines and the initial procurement costs must be kept low. However, high requirements apply in undiminished form to the print quality.

ESSENCE OF THE INVENTION

All of those skilled in the art have previously assumed, as even the latest literature and products show, that if current is introduced via the outer circumference of the impression roller (gravure printing) or the printing plate cylinder (flexographic printing), the use of a voltage electrode extending as far as possible over the entire length of the impression roller or printing plate cylinder is imperative for a homogeneous charge distribution in the imprint region. Surprisingly, it has now been found that if a voltage electrode which is shorter than 50% of the length of the impression roller or the printing plate cylinder is used, and at the same time a three-layer impression roller (gravure printing) or a three-layer printing plate cylinder (flexographic printing) is used, excellent print qualities can be achieved, like those previously achieved only with voltage electrodes of at least virtually complete length. The voltage electrode is fitted at a gap distance from the outer circumference of the impression roller or of the printing plate cylinder and, depending on the high voltage applied and the safety margins associated with this, can be shortened down to about 1% of the previous complete length.

As alternatives to the bar-like voltage electrodes, there were found those which surround the outer circumference of the impression roller or of the printing plate cylinder in a curved shape at a gap distance. The homogeneous distribution of charge over the entire impression area is achieved by utilizing the relatively low-resistance highly conductive layer of the impression roller or of the printing plate cylinder in the axial direction and the opposite high-resistance semiconductor layer in the radial direction.

In order to increase the safety, insulation of the ends of the impression roller or of the printing plate cylinder from their cores is provided by means of the application of an insulating coating, which extends at least from the highly conductive layer into the adjacent regions of the semiconductor layer lying above and the insulating layer lying below. It is also possible for the insulation to be achieved by shortening the highly conductive layer at the ends, and filling the clearance produced by the shortening with the semiconductor or insulating layer.

BRIEF DESCRIPTION OF THE APPENDED DRAWINGS

In the drawings:

FIG. 1C shows a two-roller system of a gravure printing unit with bar-like voltage electrode according to the prior art, as a perspective illustration;

FIG. 1D shows the system according to FIG. 1C as viewed in vertical section;

FIG. 1E shows the electric circuit diagram of the system according to FIGS. 1A to 1D;

FIG. 7A shows the electrostatic arrangement according to the invention for a flexographic printing unit, having an elongate voltage electrode arranged at the top on the three-layer printing plate cylinder, the back-pressure cylinder and the substrate transfer roll, as a perspective illustration;

FIG. 7B shows the arrangement according to FIG. 7A with a voltage electrode which can be positioned variably and a dip roll, as a basic illustration;

EXEMPLARY EMBODIMENTS

Figure 1A:
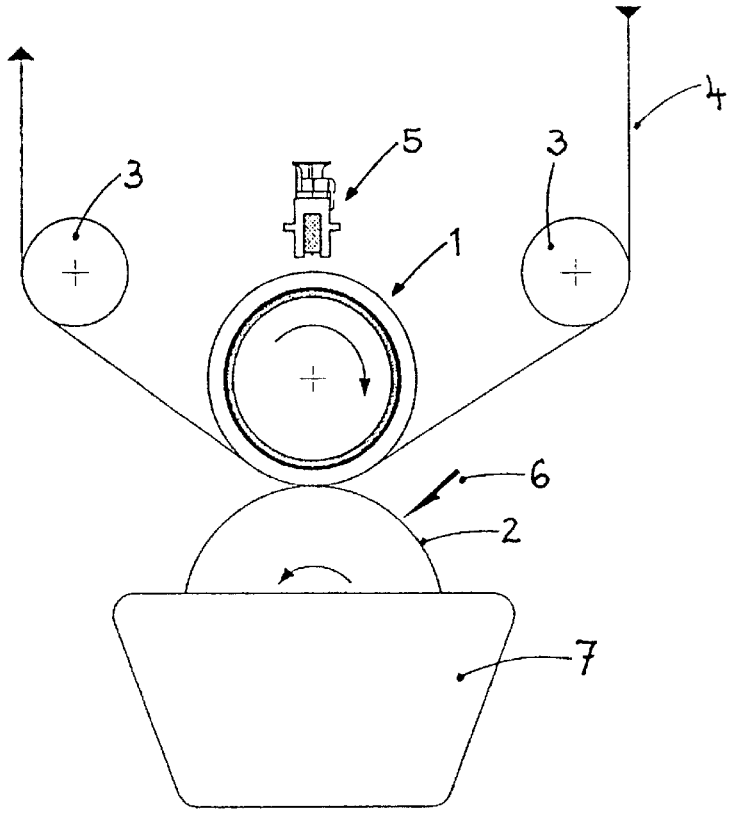
FIG. 1A shows a two-roller system of a gravure printing unit with printing plate cylinder, impression roller and voltage electrode, arranged on the latter, as a basic illustration.
Figure 1B:
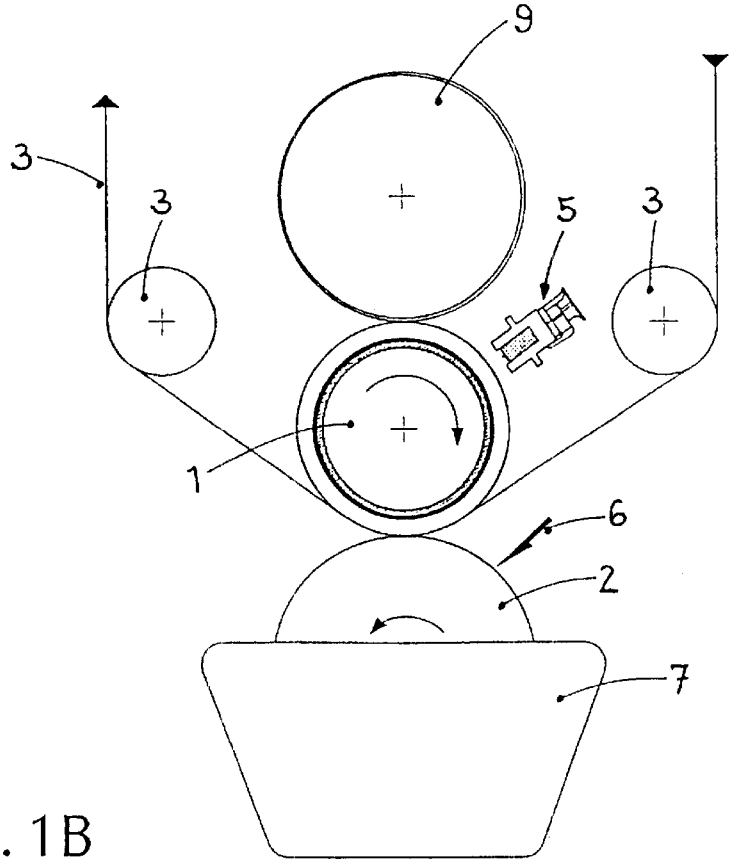
FIG. 1B shows a three-roller system of a gravure printing unit with printing plate cylinder, supporting roll and impression roller, with voltage electrode arranged thereon.

With reference to the appended drawings, there follows below the more detailed description of preferred exemplary embodiments of the arrangement according to the invention. Finally, possible modifications will be mentioned.

The following definition applies to all of the further descriptions. If reference numbers are contained in a figure for the purpose of unambiguity in the drawing, but are not explained in the directly associated descriptive text, then reference is made to their mention in the preceding figure descriptions. In the interest of clarity, the repeated designation of components is mostly omitted in following figures, if it can clearly be seen from the drawing that these are "repeating" components.

Figure 2A:
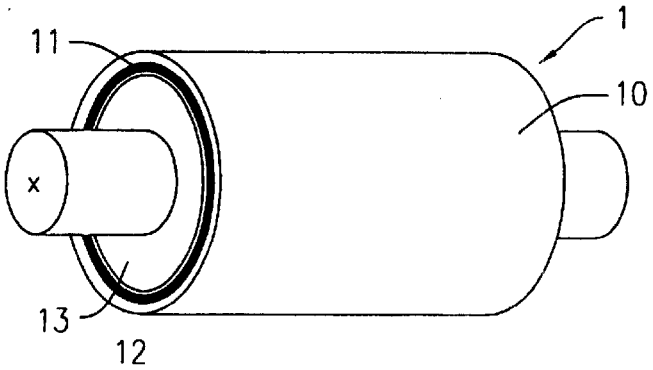
FIG. 2A shows a three-layer impression roller in a perspective illustration with continuous layers according to the prior art.
Figure 2B:
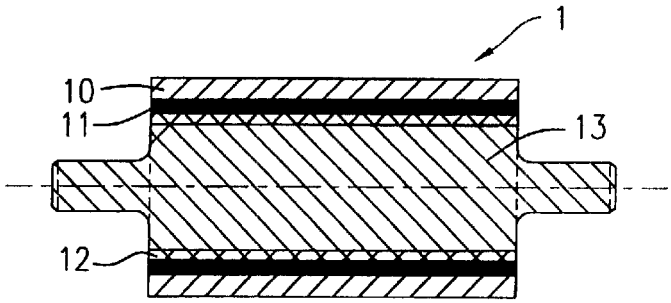
FIG. 2B shows the three-layer impression roller according to FIG. 2A in an axial vertical section.

FIGS. 2A and 2B

The three-layer impression roller 1 has, over the impression roller core 13, a cover, which on the outside comprises a semiconductor layer 10, a highly conductive layer 11 underneath and insulating layer 12 underneath the latter and adjacent to the impression roller core 13. All three layers, 10, 11, 12, extend as far as the ends of the impression roller 1, so that in particular if they are contaminated, for example by ink residues, an electrical short circuit can be produced. In order to prevent this, various insulating precautions are taken. The highly conductive layer 11 preferably has a large volume and is, for example, at least ⅓ of the thickness of the semiconductor layer 10.

FIG. 2C

Here, for insulation purposes, the highly conductive layer 11 and the insulating layer 12 are provided at each end of the multi-layer impression roller 1 with an insulating coating 14 as far as the adjacent regions of the outermost semiconductor layer 10 and of the inner roller core 13.

FIG. 2D

The insulation at the ends of the multi-layer impression roller 1 is achieved here by setting back and shortening the highly conductive and semiconductor layers 11, 10 on both sides, and filling the clearance produced by the shortening with the overlapping insulating layer 12, which, so to speak, is drawn up as far as the outermost surface of the semiconductor layer 10 and which surrounds the cut edges of both of the shortened highly conductive and semiconductor layers 11, 10.

FIG. 2E

Figure 2C:
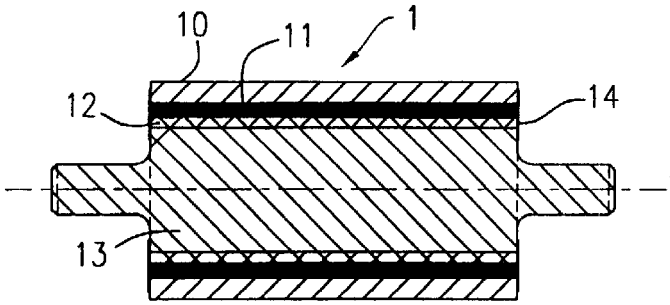
FIG. 2C shows the three-layer impression roller according to FIG. 2A with an insulating coating at the ends in accordance with the prior art.
Figure 2D:
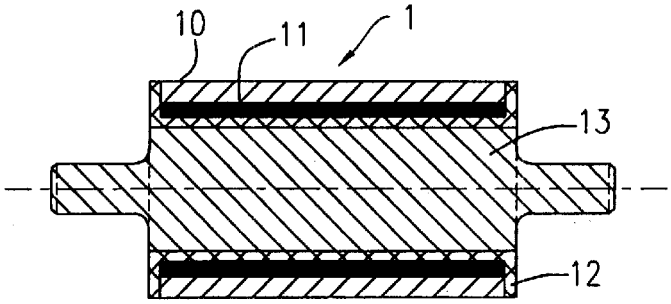
FIG. 2D shows the three-layer impression roller according to FIG. 2A with the insulating layer drawn up at the ends in accordance with the prior art.

In a modification of the embodiment according to FIG. 2D, here in each case only the highly conductive layer 11 is shortened at the ends of the multi-layer impression roller 1, and the clearance is filled by the semiconductor layer 10 which, so to speak, is drawn down on to the insulating layer 12 and overlaps the cut edges of the highly conductive layer 11.

Figure 2E:
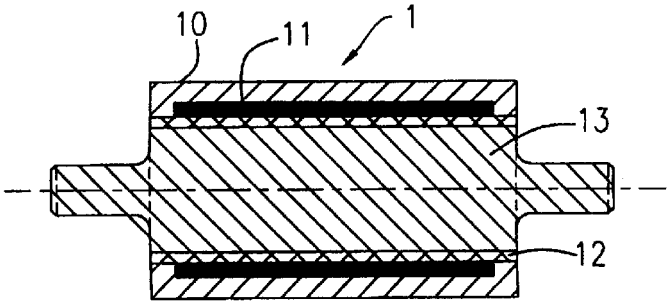
FIG. 2E shows the three-layer impression roller with the semiconductor layer set back at the ends in accordance with the prior art.
Figure 2F:
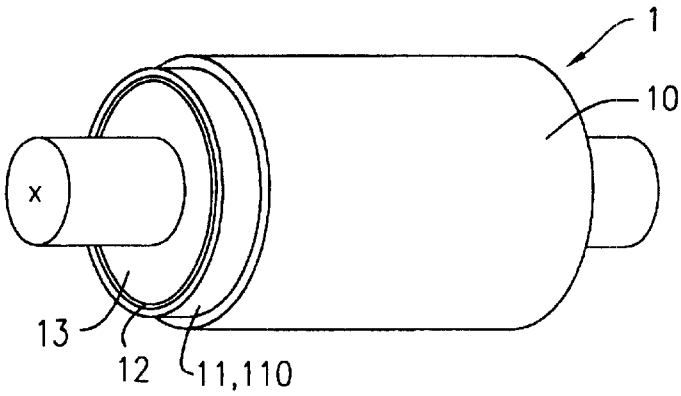
FIG. 2F shows a three-layer impression roller with a highly conductive layer exposed at the sides, as a perspective view.
Figure 2G:
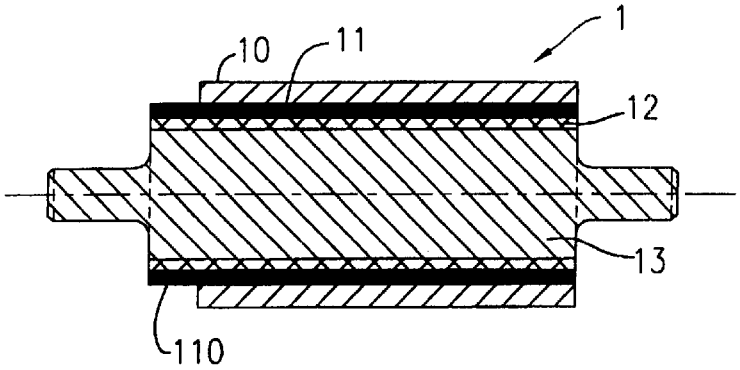
FIG. 2G shows the three-layer impression roller according to FIG. 2F in an axial vertical section.

FIGS. 2F and 2G

In the modification shown of the three-layer impression roller 1, the semiconductor layer 10 located on the outside is shortened from the left-hand end, so that an annular face 110 of the highly conductive layer 11 under the semiconductor layer 10 is exposed. As a safety precaution, it is also possible to provide on this end face an insulating coating 14, which covers the highly conductive layer 11 and the insulating layer 12 underneath and extends as far as the edge region of the adjacent impression roller core 13. The exposed annular face 110 permits a voltage electrode 5*a*, 5*b*, 5*c* (see in the following figures) to be fitted thereto. For this purpose, preference is given to a voltage electrode 5*d* with direct electrical contact, that is to say a brush or a slip ring.

Figure 3A:
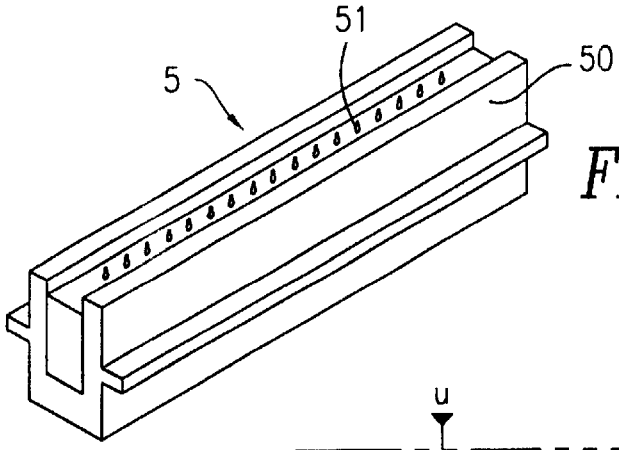
FIG. 3A shows an elongate voltage electrode according to the prior art, as a perspective illustration.
Figure 3B:
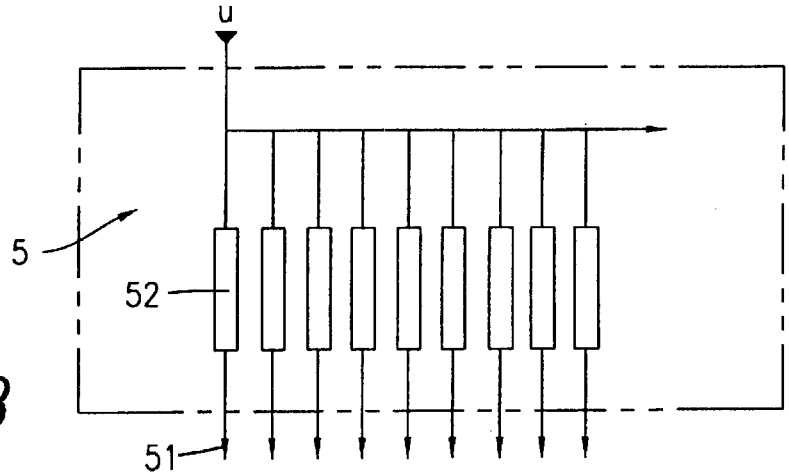
FIG. 3B shows the electric circuit diagram of the voltage electrode according to FIG. 3A.
Figure 3C:
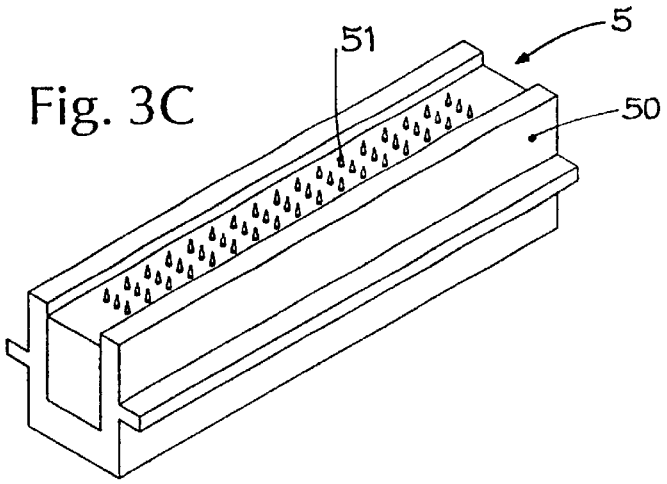
FIG. 3C shows an elongate voltage electrode having a number of rows of emission needles, as a perspective illustration.
Figure 3D:
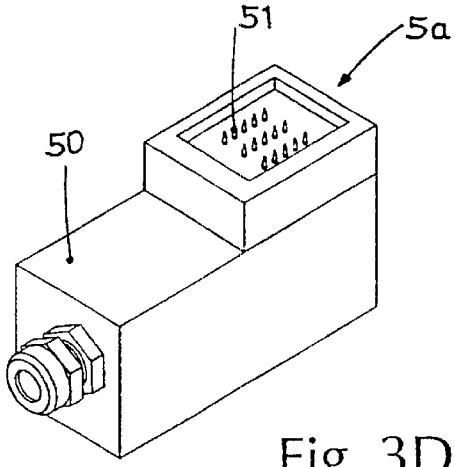
FIG. 3D shows a voltage electrode having a multi-row, square field of emission needles, as a perspective illustration.
Figure 3E:
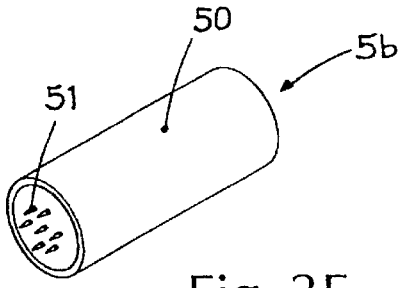
FIG. 3E shows a cylindrical voltage electrode having a number of emission needles distributed over a circular area, as a perspective illustration.

FIGS. 3A and 3B

The bar-like voltage electrode 5, which is provided as an inductor electrode to be fitted without contact to the impression roller 1, is also known per se in terms of its construction. In an elongate insulating element 50, emission needles 51 are arranged systematically in a row, for example at a spacing of 1 cm. Connected behind each emission needle 51 is a protective resistor 52. Emission needles 51 and protective resistors 52 are advantageously positioned on a printed circuit board, which is inserted into the insulating element 50 and, for example, is potted with synthetic resin. The connecting contact of the voltage electrode 5 is connected to the high-voltage source 8, so that the voltage U is present.

FIG. 3C

This voltage electrode 5, which is likewise bar-like, differs from the embodiment according to FIG. 3A only in the fact that now, instead of a row of emission needles 51, three rows of emission needles 51 extending axially are provided. This permits the overall length of the voltage electrode 5 to be shortened further and/or permits the necessary high voltage U to be reduced.

FIG. 3D

With an appropriate high voltage U and the usual suitable machine parameters, the number of emission needles 51 for a voltage electrode 5*a* can be reduced further—here they are arranged in an approximately square field—and thus the dimension of the voltage electrode 5*a* can be reduced further.

FIG. 3E

In the case of this voltage electrode 5*b*, the emission needles 51 are arranged within a circular area, and the insulating element 50 has a cylindrical shape.

Figure 4A:
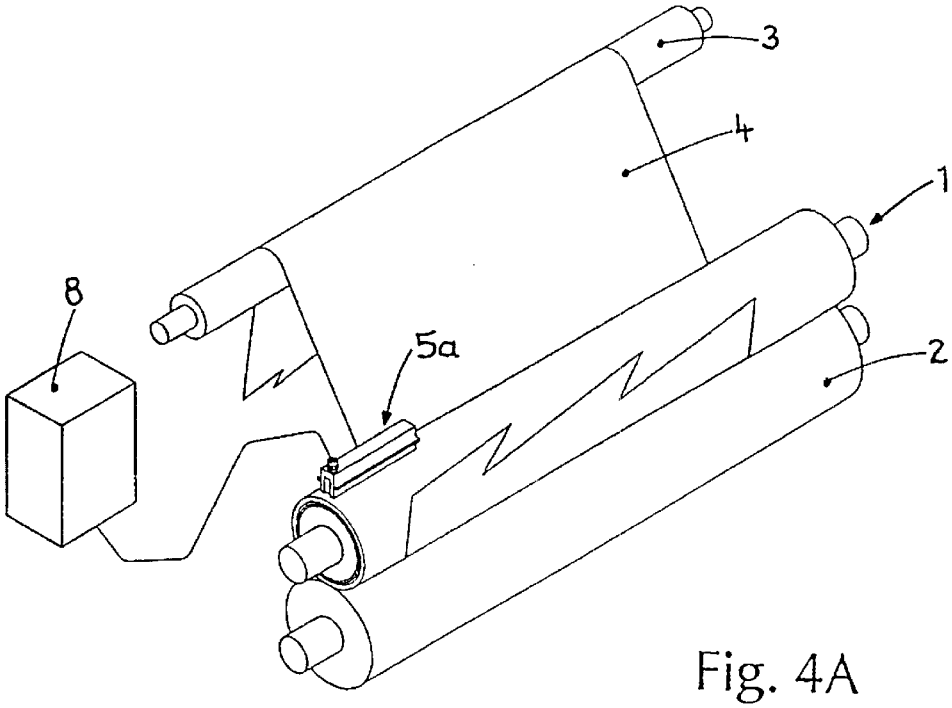
FIG. 4A shows an embodiment of the electrostatic arrangement according to the invention for a gravure printing unit, having an elongate voltage electrode arranged on the impression roller, as a perspective illustration.
Figure 4B:
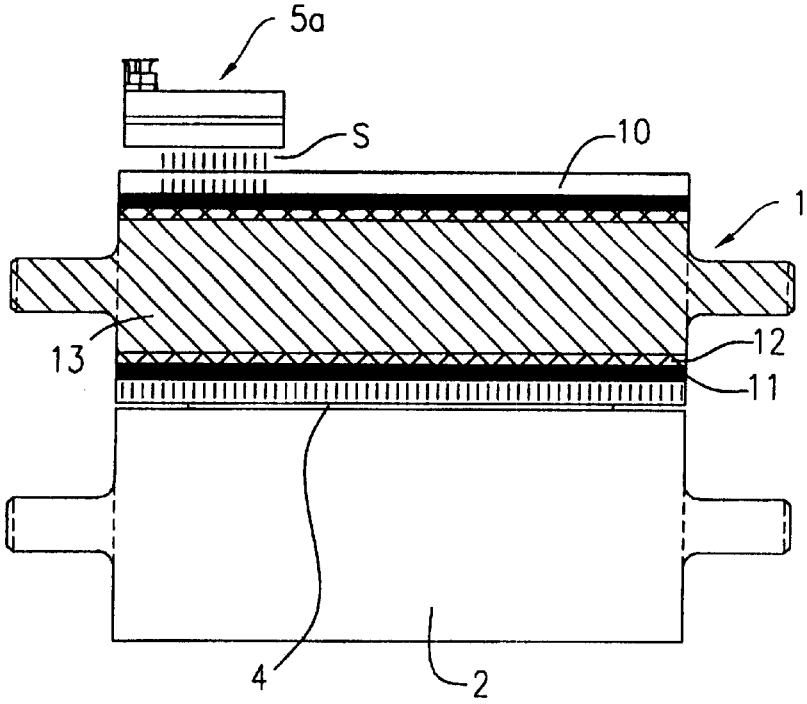
FIG. 4B shows the arrangement according to FIG. 4A as viewed in cross section.
Figure 4C:
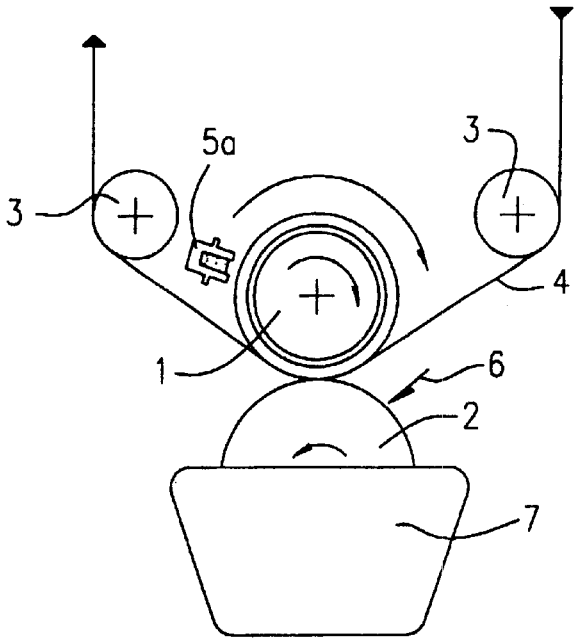
FIG. 4C shows the arrangement according to FIG. 4A with a voltage electrode which can be positioned variably.

FIGS. 4A to 4C

In this embodiment, the bar-like voltage electrode 5*a*, whose overall length is shortened, for example down to ⅙ of the length of the three-layer impression roller 1, as a non-contacting inductor electrode in a gravure printing unit, is put on to an impression roller 1 leaving an air gap therebetween of distance S. It is preferable for one end of the impression roller 1 to be chosen for the fitting of the voltage electrode 5*a*, in order in this way to facilitate access at the side for service operations. Depending on the construction of the gravure printing machine, the voltage electrode 5*a* can advantageously by arranged in any position in the semicircle around the impression roller 1, above the running web of the printing material 4.

In the event of special conditions, arranging the voltage electrode 5*a* underneath the printing material 4 and oriented toward the semiconductor layer 11 of the impression roller 1 is also conceivable. The printing material 4, for example moist paper, then acts as a current conductor. The voltage electrode 5*a* is connected to the high-voltage source 8, so that a current flow takes place from the voltage electrode 5*a* through the impression roller 1, and the polarization of the ink molecules in the dimples in the printing plate cylinder 2 is produced. For instance, the applied high voltage amounts to 30 kV DC, and the air gap S is set to 5 mm to 15 mm.

The printing materials 4 considered for use with the arrangement according to the invention are all current paper types and grades, plastic films, textiles and metal foils which have been coated or laminated with insulating varnish. All the inking systems which can be used on gravure printing machines, such as inks based on toluene, alcohol or ethyl acetate, and water-based inks, can be used for packaging and illustration printing.

Figure 5A:
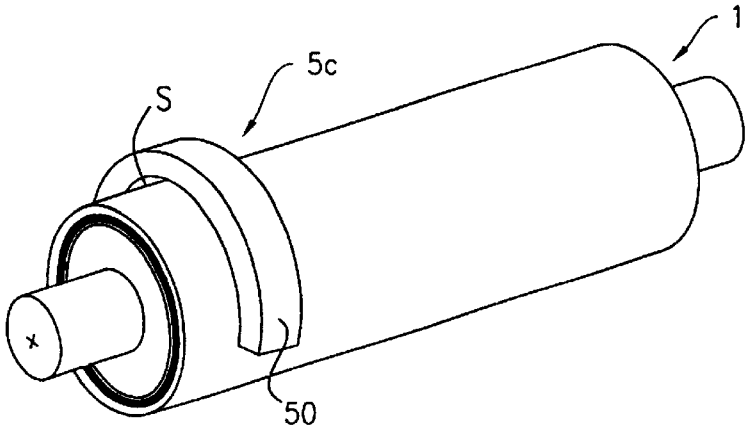
FIG. 5A shows a further embodiment of the electrostatic arrangement according to the invention for a gravure printing unit, having an impression roller and an arcuate voltage electrode fitted thereto, as a perspective illustration.
Figure 5B:
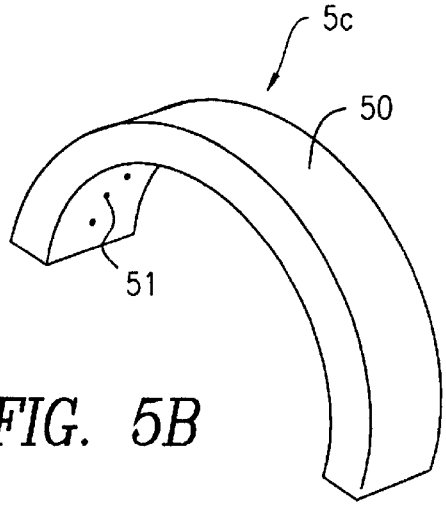
FIG. 5B shows the semi-arcuate voltage electrode according to FIG. 5A as a perspective illustration.
Figure 6:
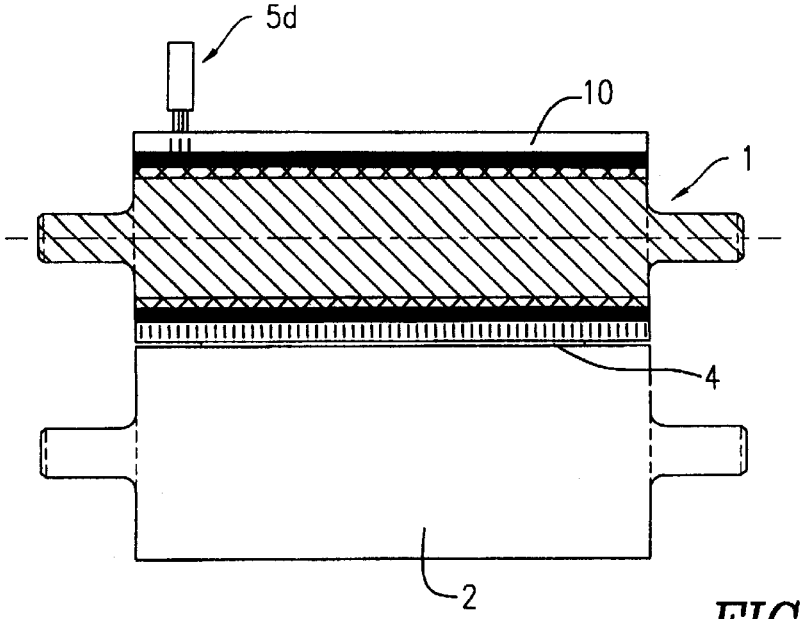
FIG. 6 shows a further embodiment of the electrostatic arrangement according to the invention for a gravure printing unit, having an impression roller, a voltage electrode fitted to the latter in the form of a slip ring or a brush, as well as a printing plate cylinder, viewed in an axial vertical section.

FIGS. 5A and 5B

In this embodiment, the voltage electrode 5*c*, likewise as a non-contacting inductor electrode, has the shape of a half shell and surrounds the three-layer impression roller 1 at a gap distance S. For example, the voltage electrode 5*c*, with its insulating element 50, extends in an arc over 180°, a row of emission needles 51 being provided therein. Here, too, for the purpose of easier access for service operations, the voltage electrode 5*c* will be arranged at least close to one end of the impression roller 1. In this example, the length of the arc-like voltage electrode 5*c* corresponds approximately to half the outer circumference of the impression roller 1, if one ignores the necessary increase caused by the gap distance S.

FIG. 6

This embodiment of the voltage electrode 5*d* is configured as a slip ring or electrically conductive brush. The ends of the slip ring or brush are placed with direct contact on the semiconductor layer 10 of the rotating impression roller 1. Of course, there is no air gap S here. The preferred positioning of the voltage electrode 5*d* is again at least close to one end of the impression roller 1. The voltage electrode 5*d* is likewise connected to the high-voltage source 8, so that a current flow takes place from the voltage electrode 5*d*—here not without contact—through the impression roller 1, and effects the polarization of the ink molecules in the dimples in the printing plate cylinder 2.

Figure 7C:
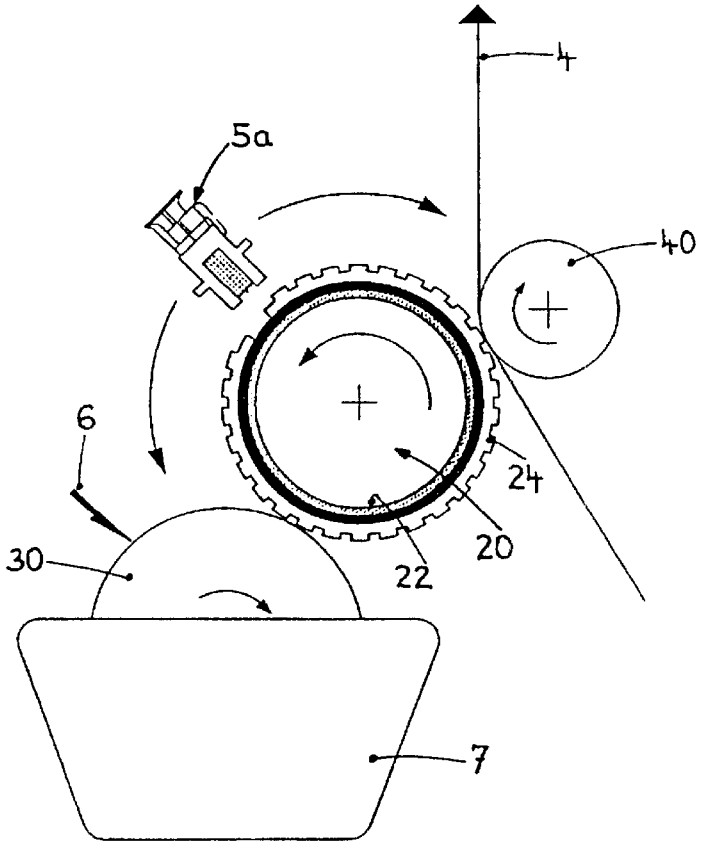
FIG. 7C shows the arrangement according to FIG. 7A with a voltage electrode which can be positioned variably and a substrate transfer roll, as a basic illustration.
Figure 7D:
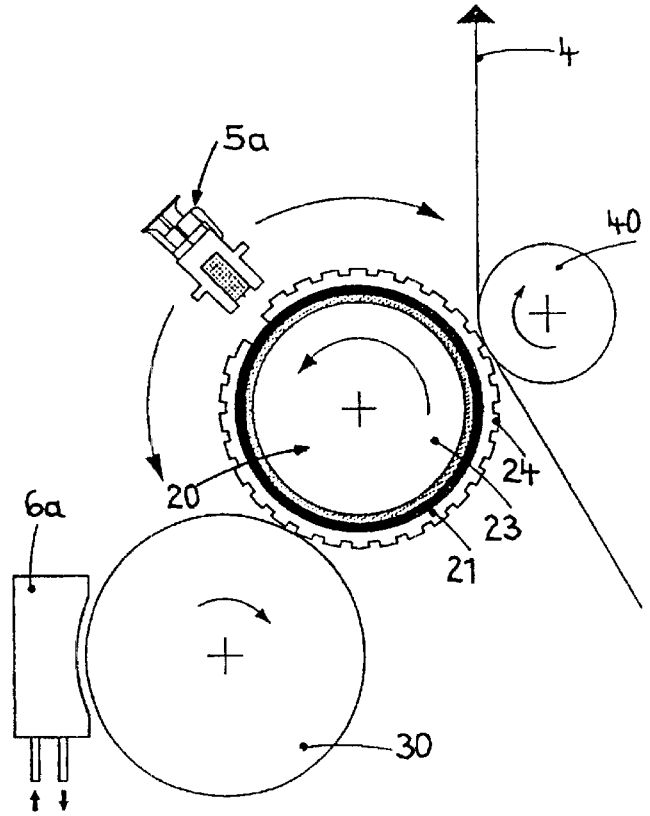
FIG. 7D shows the arrangement according to FIG. 7A with a voltage electrode which can be positioned variably and a substrate transfer roll with a chamber-type doctor, as a basic illustration.

FIGS. 7A and 7B

The flexographic printing unit has the three-layer printing plate cylinder 20, the substrate transfer roll 30 arranged underneath (also referred to as an inking roll or engraved roll) and the back-pressure cylinder 40 (also called the impression roll) located at the level of the three-layer printing plate cylinder 20. The web of the printing material 4 runs through between the three-layer printing plate cylinder 20 and the back-pressure cylinder 40.

Placed at the top on the three-layer printing plate cylinder 20, at a gap distance S, is a shortened bar-like voltage electrode 5*a*, which acts as a non-contacting inductor electrode and, for example, is about ⅙ of the length of the three-layer printing plate cylinder 20. The voltage electrode 5*a* is preferably seated at one end of the three-layer printing plate cylinder 20, in order in this way to facilitate access at the side for service operations.

The substrate transfer roll 30 is fed with the printing ink by a dip roll 60, which dips into the ink trough 7. Depending on the construction of the flexographic printing machine, the voltage electrode 5*a* can advantageously be arranged variably in all positions in the semicircle around the three-layer printing plate cylinder 20, in the two clearances between the substrate transfer roll 30 and back-pressure cylinder 40.

On the outside, the three-layer printing plate cylinder 20 has the stereotype plate 24 of the semiconductor material, underneath that a highly conductive layer 21 and, underneath the latter, an insulating layer 22. The insulating layer 22 is seated on the inner cylinder core 23. The voltage electrode 5*a* is connected to the high-voltage source 8; a current flow therefore takes place from the three-layer printing plate cylinder 20 on the one hand to the substrate transfer roll 30 and on the other hand to the back-pressure cylinder 40. The effect of the electrostatic charge is that the ink particles are transferred better from the substrate transfer roll 30 to the three-layer printing plate cylinder 20, that is say the stereotype plate 24 of the latter, and finally to the printing material 4.

FIG. 7C

In this flexographic printing unit, there is no dip roll 60, instead the substrate transfer roll 30 itself is seated in the ink trough 7, and a doctor 6 is provided to wipe off excess printing ink.

FIG. 7D

The most modern flexographic printing units likewise dispense with a dip roll 60. Here, the printing ink is sprayed onto the substrate transfer roll 30 using a chamber-type doctor 6*a*; excess printing ink is sucked off by the chamber-type doctor 6*a*.

By virtue of the invention there is now available an electrostatic arrangement as a printing aid for gravure and flexographic printing units which simplifies service operations, in particular cleaning, to a significant extent. Particular advantages are produced in terms of the accessibility in the case of service operations, as a result of the reduced dimensions with respect to the voltage electrodes used previously, primarily when the voltage electrode is arranged in an end region of the impression roller or printing plate cylinder. Because of the reduced extent of the field, deposits on machine parts of undesirably charged particles, specifically ink mist and abraded particles from printing material, are reduced. The arrangement according to the invention provides distinct cost advantages as a result of installation being made simpler and the outlay on material being reduced. Costs in terms of the homogeneity of the polarization over the entire printing width do not occur. The arrangement is primarily of benefit for retrofitting printing machines which are already in operation. The arrangement according to the invention therefore satisfies a requirement which, in principle, has existed for a long time, those skilled in the art having adhered for decades to the dogma of the necessity for widely extended voltage electrodes of the present type of electrostatic printing aids.

Further design variations relating to the above-described embodiments of the electrostatic arrangement can be implemented. Here, mention should be made expressly of the following:

—In the three-layer impression roller 1 according to FIGS. 2F and 2G, the semiconductor layer 10 could alternatively also be shortened from the right-hand end, or the semiconductor layer 10 is shortened at both ends, so that an annular face 110 of the highly conductive layer 11 is exposed to the left and/or right.

—The arc-like voltage electrode 5*c* may be configured over an arc of about 270° down to a virtually point-like dimension. Depending on the width and length of the insulating element 50, the emission needles 51 can be arranged in one or more rows and both in a fitting pattern similar to a square or circular shape. In principle, it would even be conceivable to equip a voltage electrode 5*a*, 5*b*, 5*c* with only a single emission needle 51. The insulating element 50 could be configured in a corresponding space-saving and material-saving way.

—In the flexographic printing unit, too, the various voltage electrodes 5*a*, 5*b*, 5*c*, 5*d* can be employed; exposed annular faces of the highly conductive layer 21 can be provided (cf. FIG. 2G), and similar precautions relating to the insulation of the ends are taken on the three-layer printing plate cylinder 20 (cf. FIGS. 2C to 2E).

I claim:

1. An electrostatic arrangement for a gravure printing unit for polarizing the ink molecules used in the gravure printing unit, comprising:

a multi-layer impression roller, a voltage electrode positioned relative to said impression roller such that an air gap is formed therebetween, and a printing plate cylinder positioned close to said impression roller such that a web of a printing material is feedable between said impression roller and said printing plate cylinder, said voltage electrode being an inductor electrode and having a plurality of emission needles which are spaced apart from one another, said plurality of emission needles each having a tip and, when a DC voltage is applied to said voltage electrode, current flows from said tips of said plurality of emission needles, through said air gap, and into said impression roller, and said plate cylinder having dimples to carry the ink molecules, wherein said multi-layer impression roller has an impression roller core, an outermost semiconductor layer, a highly conductive layer underneath said semiconductor layer and an insulating layer underneath said highly conductive layer and adjacent to said impression roller core, said voltage electrode being positioned such that said air gap is located between said voltage electrode and said semiconductor layer of said multi-layer impression roller; and said multi-layer impression roller has a longitudinal length and said voltage electrode extends longitudinally and axially having a length of not greater than about 50% of said length of said multi-layer impression roller.

2. The electrostatic arrangement as claimed in claim 1, wherein said plurality of emission needles of said voltage electrode are positioned at regularly spaced intervals from one another.

3. The electrostatic arrangement as claimed in claim 1, wherein said impression roller has two ends, each of said two ends including cut faces of said semiconductor layer, said highly conductive layer and said insulating layer and wherein each of said two ends is provided with an insulating coating which covers said cut faces of said highly conductive layer and said insulating layer, said insulating coating of each of said two ends extending from said semiconductor layer to said impression roller core.

4. The electrostatic arrangement as claimed in claim 1, wherein said impression roller has two ends, each of said two ends including cut faces of said semiconductor layer and said insulating layer, said highly conductive layer having cut faces that are set back from said two ends of said impression roller leaving a clearance which is filled by said semiconductive layer such that said semiconductor layer meets said insulating layer thereby surrounding said cut edges of said highly conductive layer.

5. The electrostatic arrangement as claimed in claim 1, wherein said impression roller has two ends, each of said two ends including cut faces of said insulating layer, said semiconductor layer having cut faces and an outermost surface and said highly conductive layer having cut faces and wherein said cut faces of said semiconductor layer and of said highly conductive layer are set back from said two ends of said impression roller leaving a clearance which is filled by said insulating layer such that said insulating layer meets said uppermost surface of said semiconductor layer thereby surrounding said cut edges of said semiconductor layer and of said highly conductive layer.

6. The electrostatic arrangement as claimed in claim 1, wherein said DC voltage which is applied to said voltage electrode is up to 30 kV.

7. The electrostatic arrangement as claimed in claim 1, wherein said air gap is between 5 mm and 30 mm.

8. The electrostatic arrangement as claimed in claim 1, wherein said voltage electrode is positioned at an end of said impression roller.

9. The electrostatic arrangement as claimed in claim 1, wherein said highly conductive layer and said semiconductor layer each have a thickness, said thickness of said highly conductive layer being at least ⅓ of said thickness of said semiconductor layer.

10. The electrostatic arrangement as claimed in claim 1, wherein said voltage electrode is positioned such that said air gap is formed between said voltage electrode and an end face of said highly conductive layer of said multi-layer impression roller.

11. The electrostatic arrangement as claimed in claim 1, wherein said voltage electrode is positioned such that said air gap is formed between said voltage electrode and an exposed annular face of said highly conductive layer of said multi-layer impression roller.

12. The electrostatic arrangement as claimed in claim 1, wherein said length of said voltage electrode is not greater than about 10% of said length of said multi-layer impression roller.

13. The electrostatic arrangement as claimed in claim 1, wherein said voltage electrode extends radially around said multi-layer impression roller, said voltage electrode having an arc length of not greater than about 270°.

14. The electrostatic arrangement as claimed in claim 13, wherein said arc length of said voltage electrode is not greater than about 30°.

15. An electrostatic arrangement for a flexographic printing unit for polarizing the ink molecules used in the flexographic printing unit, comprising:

a multi-layer printing plate cylinder, a voltage electrode positioned relative to said printing plate cylinder such that an air gap is formed therebetween, a substrate transfer roll and a back-pressure cylinder such that a web of a printing material is feedable between said printing plate cylinder and said back-pressure cylinder, said voltage electrode being a inductor electrode and having a plurality of emission needles spaced apart from one another, said plurality of emission needles each having a tip and, when a DC voltage is applied to said voltage electrode, current flows from said tips of said plurality of emission needles, through said air gap, and into said printing plate cylinder, and said substrate transfer roll and said printing plate cylinder carrying the ink molecules, wherein said printing plate cylinder has a cylinder core, an outermost semiconductor layer which is a stereotype plate, a highly conductive layer located underneath said semiconductor layer and an insulating layer located underneath said highly conductive layer and adjacent to said cylinder core, said voltage electrode being positioned such that said air gap is located between said voltage electrode and said stereotype plate; and said printing plate cylinder has a longitudinal length and said voltage electrode extends longitudinally and axially having a length of not greater than about 50% of said length of said printing plate cylinder.

16. The electrostatic arrangement as claimed in claim 2, wherein said voltage electrode is positioned such that said air gap is formed between said voltage electrode and an end face of said highly conductive layer of said printing plate cylinder.

17. The electrostatic arrangement as claimed in claim 2, wherein said voltage electrode is positioned such that said air gap is formed between said voltage electrode and an exposed annular face of said highly conductive layer of said printing plate cylinder.

18. The electrostatic arrangement as claimed in claim 2, wherein said length of said voltage electrode is not greater than about 10% of said length of said printing plate cylinder.

19. The electrostatic arrangement as claimed in claim 2, wherein said voltage electrode extends radially around said printing plate cylinder, said voltage electrode having an arc length of not greater than about 270°.

20. The electrostatic arrangement as claimed in claim 19, wherein said arc length of said voltage electrode is not greater than about 30°.

21. The electrostatic arrangement as claimed in claim 15, wherein said plurality of emission needles of said voltage electrode are positioned at regularly spaced intervals from one another.

22. The electrostatic arrangement as claimed in claim 15, wherein said printing plate cylinder has two ends, each of said two ends including cut faces of said stereotype plate, said highly conductive layer and said insulating layer and wherein each of said two ends is provided with an insulating coating which covers said cut faces of said highly conductive layer and said insulating layer, said insulating coating of each of said two ends extending from said stereotype plate to said cylinder core.

23. The electrostatic arrangement as claimed in claim 15, wherein said printing plate cylinder has two ends, each of said two ends including cut faces of said stereotype plate and said insulating layer, said highly conductive layer having cut faces that are set back from said two ends of said printing plate cylinder leaving a clearance which is filled by said stereotype plate such that said stereotype plate meets said insulating layer thereby surrounding said cut edges of said highly conductive layer.

24. The electrostatic arrangement as claimed in claim 15, wherein said printing plate cylinder has two ends, each of said two ends including cut faces of said insulating layer, said stereotype plate having cut faces and an outermost surface and said highly conductive layer having cut faces and wherein said cut faces of said stereotype plate and of said highly conductive layer are set back from said two ends of said printing plate cylinder leaving a clearance which is filled by said insulating layer such that said insulating layer meets said uppermost surface of said stereotype plate thereby surrounding said cut edges of said semiconductor layer and of said highly conductive layer.

25. The electrostatic arrangement as claimed in claim 15, wherein said DC voltage which is applied to said voltage electrode is up to 30 kV.

26. The electrostatic arrangement as claimed in claim 15, wherein said air gap is between 5 mm and 30 mm.

27. The electrostatic arrangement as claimed in claim 15, wherein said voltage electrode is positioned at an end of said printing plate cylinder.

28. The electrostatic arrangement as claimed in claim 15, wherein said highly conductive layer and said stereotype plate each have a thickness, said thickness of said highly conductive layer being at least ⅓ of said thickness of said stereotype plate.

* * * * *